United States Patent [19]

Gordon

[11] Patent Number: 4,736,946

[45] Date of Patent: Apr. 12, 1988

[54] LEG AND STOMACH MUSCLE EXERCISER AND WAISTLINE FORMING APPARATUS

[76] Inventor: Clara Gordon, 104-20 Queens Blvd., Forest Hills, N.Y. 11375

[21] Appl. No.: 44,148

[22] Filed: Apr. 30, 1987

[51] Int. Cl.[4] ..... A63B 21/02

[52] U.S. Cl. ..... 272/137; 272/117

[58] Field of Search ..... 272/135–139, 272/142, 122, 123, 117

[56] References Cited

U.S. PATENT DOCUMENTS

| | | | |
|---|---|---|---|
| 734,062 | 7/1903 | Harris | 272/122 |
| 4,121,827 | 10/1978 | Weider | 272/142 |
| 4,195,835 | 4/1980 | Hinds et al. | 272/137 |
| 4,199,140 | 4/1980 | Ferretti | 272/142 X |
| 4,361,324 | 11/1982 | Baroi | 272/123 |

*Primary Examiner*—Richard J. Apley
*Assistant Examiner*—J. Welsh
*Attorney, Agent, or Firm*—Michael I. Kroll

[57] ABSTRACT

A leg and stomach muscle exerciser and waistline forming apparatus is provided and consists of resiliently stretchable elongated bands connected between a handle to be gripped by two hands and a pair of foot holders with weights removably connected thereto which are manipulated through exercising motions so as to develop the leg, stomach and waistline muscles.

4 Claims, 1 Drawing Sheet

LEG AND STOMACH MUSCLE EXERCISER AND WAISTLINE FORMING APPARATUS

BACKGROUND OF THE INVENTION

1. Field of the Invention

The instant invention relates generally to exercising devices and more specifically it relates to a leg and stomach muscle exerciser and waistline forming apparatus.

2. Description of the Prior Art

Numerous exercising devices have been provided in prior art that are adapted to develop and build up various muscles of the body. For example, U.S. Pat. Nos. 821,783; 2,498,006 and 3,256,015 all are illustrative of such prior art. While these units may be suitable for the particular purpose to which they address, they would not be as suitable for the purposes of the present invention as heretofore described.

SUMMARY OF THE INVENTION

A primary object of the present invention is to provide a leg and stomach muscle exerciser and waistline forming apparatus that will overcome the shortcomings of the prior art devices.

Another object is to provide a leg and stomach muscle exerciser and waistline forming apparatus in which various weights can be attached to the foot holders of the apparatus to enhance use of the exerciser.

An additional object is to provide a leg and stomach muscle exerciser and waistline forming apparatus which will develop leg, stomach and waistline muscles when properly used with the various weights attached thereto.

A further object is to provide a leg and stomach muscle exerciser and waistline forming apparatus that is simple and easy to use.

A still further object is to provide a leg and stomach muscle exerciser and waistline forming apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
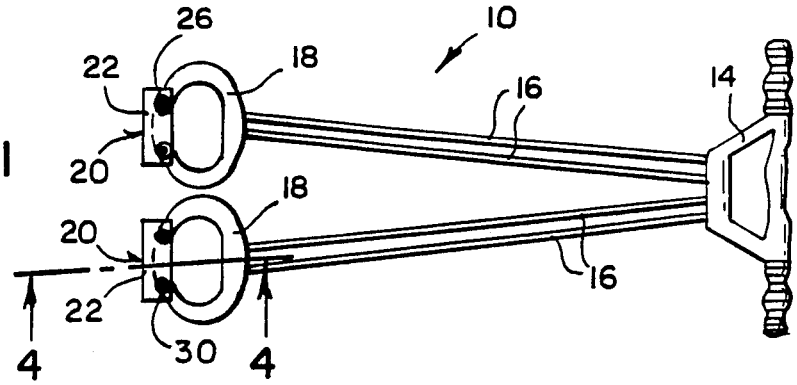
FIG. 1 is a top plan view of the invention.

Turning now descriptively to the drawings, in which similar reference characters denote similar elements throughout the several views, FIGS. 1 through 4B illustrate a leg and stomach muscle exerciser and waistline forming apparatus 10 consisting of a handle 14 of sufficient length to permit gripping by two hands 11 of a person 12 using the apparatus 10. A pair of holders 18 are adapted to be engaged by feet 13 of the person 12. A plurality of weights 20 are provided and are removably connected to the holders 18. A plurality of resiliently stretchable elongated bands 16 are connected between the handle 14 and the holders 18 for tensioning muscles when the holders 18 with the weights 20 are manipulated through exercising motions so as to develop the leg, stomach and waistline muscles.

Figure 4:
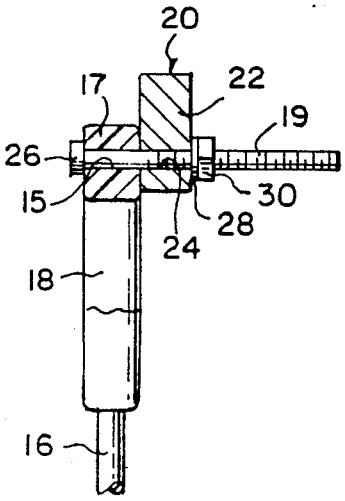
FIG. 4 is an enlarged cross sectional view taken along line 4—4 in FIG. 1.
Figure 4A:
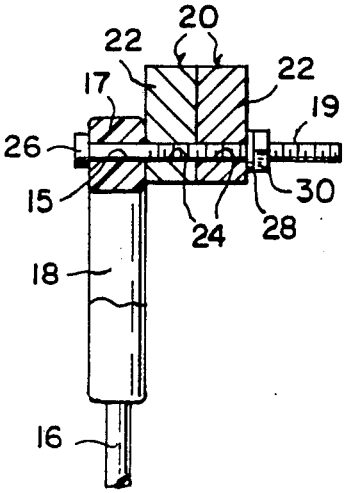
FIG. 4A is an enlarged cross sectional view similar to FIG. 4 showing two weights attached thereto.
Figure 4B:
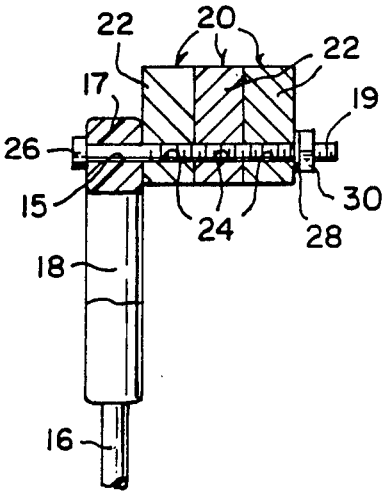
FIG. 4B is an enlarged cross sectional view similar to FIG. 4 showing three weights attached thereto.

Each of the weights 20 are in block form 22 and fabricated out of heavy metal material. Each of the weights 20 has a pair of spaced apart transverse holes 24 at one side thereof. Each of the holders 18 has a pair of spaced apart transverse holes 15 at distal end 17 thereof. A bolt 26 extends through each of the holes 15 at the distal end 17 of the holder 18 and one of the holes 24 in the weight 20 so that most of the weight extends outwardly away from the distal end 17 of the holder 18. A washer 28 is placed onto each of the bolts 26 and a nut 30 is threaded onto each of the bolts 26 to hold the weight 20 secure thereto as best seen in FIG. 4. Each of the bolts 26 includes a shank 19 having a length long enough to hold two or three of the weights 20 secure thereto at one time as best seen in FIGS. 4A and 4B.

Figure 3:
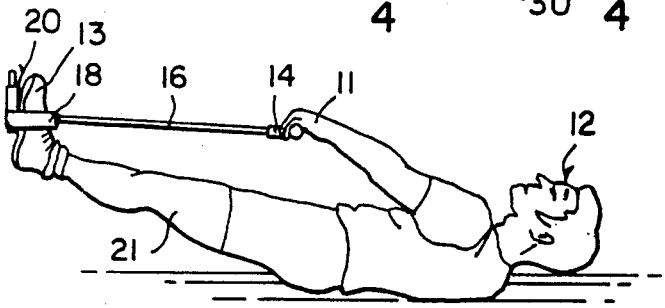
FIG. 3 is a side view of a person using the apparatus for stomach exercises.
Figure 2:
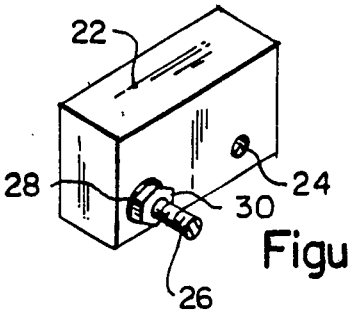
FIG. 2 is a perspective view of one of the weights.
Figure 3A:
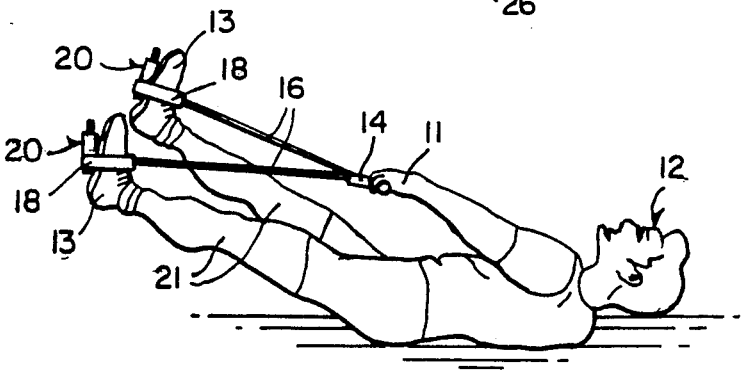
FIG. 3A is a side view of the person using the apparatus for leg exercises.

FIG. 3 shows the apparatus 10 being used by the person 12 with legs 21 together for stomach exercises while FIG. 3A shows the apparatus 10 being used by the person 12 with legs 21 slightly apart for leg exercises.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

Importantly, since athletes use an increasing amount of weights to develop arm and shoulder muscles the instant exerciser apparatus 10 easily permits the additional of said weights so that muscle development may be easily accomplished.

What is claimed is:

1. A leg and stomach muscle exerciser and waistline forming apparatus which comprises:

(a) a handle of sufficient length to permit gripping by two hands of a person using said apparatus;

(b) a pair of holders adapted to be engaged by feet of the person and each having an inward side facing said handle and an outward side facing away from said handle;

(c) a plurality of weights;

(d) means for removably connecting each of said weights to said outward side of said each holder of said pair of holders allowing said plurality of weights to be furthest away from said handle so that greater resistive force is supplied with a lesser amount of said plurality of weights; and (e) a plurality of resiliently stretchable elongated bands connected between said handle and said inward side of said each holder of said pair of holders for tensioning muscles when said holders with said weights are manipulated through exercising motions so as to develop the leg, stomach and waistline muscles.

2. A leg and stomach muscle exerciser and waistline forming apparatus as recited in claim 1, wherein each of said weights are in block form and fabricated out of a heavy metal material.

3. A leg and stomach muscle exerciser and waistline forming apparatus as recited in claim 2, wherein said connecting means includes:

(a) each of said weights having a pair of spaced apart transverse holes at one side thereof;

(b) each of said holders having a pair of spaced apart transverse holes at distal end thereof;

(c) a pair of bolts, each extending through one of the holes at the distal end of said holder and one of the holes in said weight so that most of said weight extends outwardly away from the distal end of said holder;

(d) a pair of washers, each placed onto one of said bolts; and (e) a pair of nuts, each threaded onto one of said bolts to hold said weight secure thereto.

4. A leg and stomach muscle exerciser and waistline forming apparatus as recited in claim 3, wherein each of said bolts includes a shank having a length long enough to hold at least three of said weights secure thereto at one time.

* * * * *